United States Patent [19]

Kabakov et al.

[11] Patent Number: 4,817,296

[45] Date of Patent: Apr. 4, 1989

[54] DRY-CLEANING MACHINE FOR TEXTILES

[76] Inventors: Vladimir M. Kabakov, ulitsa Profsojuznaya, 21, korpus 4 4, kv. 174, Moscow; Ivan E. Razinkov, Zheleznodorozhny pereulok, 2a, kv. 75, Kharkovskaya oblast, Gotvald, both of U.S.S.R.

[21] Appl. No.: 117,674

[22] Filed: Nov. 5, 1987

[30] Foreign Application Priority Data

Dec. 16, 1986 [SU] U.S.S.R. ..... 4157466

[51] Int. Cl.[4] ..... D06F 43/08

[52] U.S. Cl. ..... 34/77; 68/18 C; 68/18 F

[58] Field of Search ..... 8/142, 158; 68/18 R, 68/18 C, 18 F; 34/77

[56] References Cited

U.S. PATENT DOCUMENTS

| | | | |
|---|---|---|---|
| 2,301,803 | 11/1942 | Davis | 68/18 R X |
| 2,656,696 | 10/1953 | McDonald | 68/18 R |
| 2,660,869 | 12/1953 | McDonald | 68/18 R |
| 3,538,615 | 11/1970 | Fuhring et al. | 68/18 F X |
| 3,557,581 | 1/1971 | Donini et al. | 68/18 F |

FOREIGN PATENT DOCUMENTS

| | | | |
|---|---|---|---|
| 1121014 | 1/1962 | Fed. Rep. of Germany | 16/18 R |

*Primary Examiner*—Philip R. Coe

*Attorney, Agent, or Firm*—Burgess, Ryan and Wayne

[57] ABSTRACT

The machine of the invention comprises the following components interconnected through air conduits; a cage drum rotatably mounted in a housing, an air cleaner for intercepting mechanical impurities, an air cooler, an air heater with a steam heating element, an adsorber with respective inlet and outlet connections for steam admission and discharging a mixture of steam and adsorbed solvent. The machine comprises also a system of directional valves for changing the direction of air flow therethrough and a means for cooling and separating a mixture of condensates of steam and solvent, which is connected, through a device for condensate separation and discharge, to the outlet of the steam heating element of the air heater.

The inlet of steam heating element is connected to an outlet connection for discharging a mixture of steam and desorbed solvent vapors from the absorber. The amount of adsorbent contained in the adsorber and its adsorption capacity are so selected as to provide catching of the solvent vapors at the final stage of drying the textiles under process involving air circulation through the cage drum and the adsorber within one operating cycle of the machine.

6 Claims, 4 Drawing Sheets

DRY-CLEANING MACHINE FOR TEXTILES

FIELD OF THE INVENTION

1. Cross-Reference to Related Applications

This application is a continuation-in-part of application Ser. No. 017,888, filed Feb. 20, 1987.

This invention relates generally to equipment for treatment of various articles with chemical solvents followed by their recovery and more specifically to a dry-cleaning machine for textiles.

The invention can find most utility when applied for dry-cleaning of clothing and other textiles with such organochloric solvents as perchlorethylene and trichloroethylene involving closed recirculation systems of their recovery.

The invention is also applicable for dry-cleaning of textiles with other solvents, as well as in some other fields of engineering for treating various articles followed by recovery of the solvents.

2. Description of the Prior Art

Among the principal characteristics that define the performance of dry-cleaning machines for textiles are specific consumption of organic solvents used for treatment of textiles and the degree of environmental pollution due to fouling the atmospheric air and sewage water. It is for improving said characteristics that use is commonly made of dry-cleaning machines featuring closed recirculation system of solvents' recovery at every stage of treatment and drying of the textiles under process.

One state-of-the-art dry-cleaning machine for textiles U.S. Pat. No. 3,807,948) provided with a closed solvent recovery system is known to comprise a rotary perforated (cage) drum enclosed in a housing and adapted for treatment of textiles with organic solvents, and the following components communicating therewith through air conduits: a blast fan for air displacement in drying the textiles under process, an air cleaner to get the air rid of mechanical impurities, an air cooler with a water cooling system, an evaporator of a refrigerating machine, and a system of directional valves for changing the direction of air flow through the machine.

In the course of drying the textiles treated with organic solvents beforehand, air is made to circulate, with the aid of the blast fan, through the cage drum, air cleaner, water-cooled air cooler, air heater, and evaporator of a refrigerating machine. The organic solvents are recovered from the circulating air by virtue of their condensation occurring upon air cooling in the cooler and the evaporator of a refrigerating machine.

A disadvantage inherent in the machine mentionoed above resides in the fact that it fails to provide complete recovery of the solvents from the air being cooled in the course of their condensation. For instance, 17 g perchloroethylene or 70 g trichlorethylene remains unrecovered in one cubic meter of air at 15° C. This results in loss of organic solvents which escape into the atmospheric air when the treated textiles are being unloaded from the cage drum, and hence in environmental pollution.

Other disadvantages of the machine discussed above reside in much time spent for air cooling for solvents to condensate which prolongs the duration of the drying process, as well as in additional power consumption for operation of the refrigerating unit.

In addition, use of a refrigerating unit complicates the construction of the machine and imposes much higher requirements upon the skill of the attending personnel.

Another state-of-the-art dry-cleaning machine for textiles (cf. Express information of the Central Office for Scientific and Technical Information, Ministry of Household Services of the RSFSR, Series IV, issue 3, 1980, June (Moscow), A. M. Epifanov, M. A. Kochetkov "Special construction and operation features of dry-cleaning machine Spetsima-212", pp.6–8, 14–19 (in Russian) is known to comprise the following components intercommunicating through air conduits: perforated (cage) drum for treatment of textiles with organic solvents, said drum being rotatably mounted in a housing, a blast fan for air displacement in drying the textiles under process, an air cleaner to get the air rid of mechanical impurities, a water-cooled air cooler, a steam air heater provided with a device for separating steam-vapour and solvent-vapour condensate and discharging the latter from the heater, an adsorber containing an adsorbent and provided with an inlet connection for steam to be admitted thereto and with an outlet connection for discharging steam along with desorbed solvent vapours and condensate from the adsorber, and a system of directional valves for changing the direction of air flow through the machine.

The outlet connection for discharging the steam and desorbed solvent vapours is connected to a device for their condensation which in turn communicates with a settler-type device for separating said mixture of steam and desorbed solvent vapours into the solvent and water.

The adsorber is filled with adsorbent the amount and adsorption capacity of which are so selected as to provide catching of the solvents vapours at the final stage of drying the textiles under process involving air circulation through the cage drum and the adsorber within 20 to 30 operating cycles of the machine.

Connected to the adsorber are the blast fan and the air heater for the adsorbent to dry in the course of its regeneration.

A disadvantage inherent in the machine described above resides in a great amount of steam spent for solvent desorption and drying the textiles under process and the adsorbent, as well as of cooling water spent for condensation of a mixture of steam vapour and desorbed solvents vapour admitted from the adsorber.

Another disadvantage of the machine under consideration consists in loss of solvent during drying of the adsorbent, in the course of which the part of solvent that has incompletely been desorbed from the adsorber is free to escape into the atmospheric air.

Furthermore, as the number of machine operating cycles involving no desorption of the solvent increases, the amount of the solvent breakthrough rises gradually, which results in deteriorated quality of drying of the textiles under process, whereas the solvent remaining in the cage drum gets into the atmosphere during unloading of the treated textiles.

One more disadvantage of the machine lies with a necessity for its periodical halts for desorption of the solvent and regeneration of the adsorbent. This in turn affects adversely throughput of the machine and complicates its operation.

OBJECTS AND SUMMARY OF THE INVENTION

It is an object of the present invention to reduce the loss of organic solvents in the course of operation of dry-cleaning machines.

It is another object of the present invention to prevent environmental pollution.

It is still another object of the present invention to reduce power consumption rate for dry-cleaning of textiles.

It is yet still another object of the present invention to increase the throughput of a dry-cleaning machine.

It is one more object of the present invention to provide a simpler construction of a dry-cleaning machine and to render its altendance more convenient.

It is still more object of the present invention to provide better quality of drying of textiles under process.

Said and other objects are accomplished due to the fact that in a dry-cleaning machine for textiles, comprising the following components intercommunicating through air conduits: a cage drum rotatably mounted in a housing, a blast fan, an air cleaner for getting air rid of mechanical impurities, an air cooler, a steam air heater provided with a device for condensate separation and and discharging therefrom, an adsorber containing adsorbent and provided with an inlet connection for steam admission during desorption of the solvent from adsorbent and with an outlet connection for a mixture of steam vapour and desorbed solvent vapour to be discharged, as well as a system of directional valves for changing the direction of air flow through the machine during drying the textiles under process and for preventing steam from penetration into the cage drum during solvent desorption, and a means for cooling and separating a mixture of condensates of steam and desorbed solvent vapours, according to the invention, the outlet connection for discharging a mixture of steam vapour and desorbed solvent vapour communicates with the inlet of the steam air heater, the outlet of the latter being connected, through the device for condensate separation and discharge, to the means for cooling and separating a mixture of condensates of steam and desorbed solvent vapours, while the amount of adsorbent and its adsorption capacity are so selected as to provide catching of the solvent vapours at the final stage of drying the textiles under process involving air circulation through the cage drum and the adsorber within one operating cycle of the machine.

The herein-proposed machine is capable of carrying out desorption of the solvent that has been caught during the previous operating cycle of the machine, from adsorbent concurrently with air circulation through the cage drum, air cleaner and air heater in the course of drying the textiles under process. Steam vapour that has passed through the adsorbent is condensed along with the vapours of the desorbed organic solvent in the air heater by virtue of being cooled with the circulating air which in turn is heated due to the heat of condensation. Thus, a total steam consumption for solvent desorption and drying the textiles under process is reduced, whereas consumption of cooling water spent for condensation of a mixture of steam vapour and desorbed solvent vapour admitted from the adsorber is dispensed with completely.

Since desorption of an organic solvent from adsorbent occurs automatically without participating of an operator, and the process takes no additional time, the machine attenance is simplified and its throughout capacity increases.

Higher efficiency of solvent desorption and adsorbent regeneration which are carried out within each operating cycle of the machine, results in a reduced solvent consumption and prevents environmental pollution with the solvent.

Practically complete removal of organic solvents from the cage drum improves the quality of drying the textiles under process. Moreover, a small amount of steam condensate is left after each operating cycle of the machine, which condensate is admitted to the cage drum in an atomized state due to air circulation through the adsorber and the cage drum during a next operating cycle of the machine. This precludes any possibility of reducing the moisture content of the textiles under process below normal level.

Inasmuch as the amount of adsorbent charged in the adsorber is designed for but one technological cycle of textiles treatment, the size of the adsorber is considerably decreased and hence are the overall dimensions of the machine as a whole.

It is expedient that the means for cooling and centrifugal separation of a mixture of condensates of steam and solvent be made up of two cooling chambers interconnected through their bottom portion, one of said chambers being shaped as a body of revolution provided with a tangential inlet connection for admission of the mixture being separated and with an outlet connection arranged on the centre line of the chamber and adapted for steam condensate to discharge, while the other chamber has an outlet connection for the solvent to discharge, The aforesaid means enables one to enhance the efficiency of separation of the condensates of steam and desorbed solvent which are fed from the air heater and prevents the solvents from getting in sewage water along with the steam condensate being discharged.

Besides, cooling water consumption is reduced due to a high temperature of the condensate separated in said means.

According to one of the constructional embodiments of the invention, the means for cooling and separating a mixture of condensates of steam and solvent vapours is connected, through an air conduit, to the blast fan. This provides for air circulation through the machine during displacement of the residual steam and condensate from the adsorber after solvent desorption which in turn prevents any possibility of solvent losses along with the air escaping from the machine, as well as rules out compressed air consumption for performing the aforesaid operation.

According to another constructional embodiment of the invention the adsorber is provided with an inlet connection for compressed air to admit therein in order to displace residual steam and condensate therefrom after solvent desorption. This enables displacement of residual steam and condensate from the adsorber concurrently with drying the textiles and air circulation through the machine.

According to one more constructional embodiment of the invention, the adsorber is made up of at least two parallel-connected chambers charged with adsorbent. Such a construction arrangement of the adsorber is expedient to be used in a machine featuring a large charging mass. This makes it possible to fill each chamber with such an amount of adsorbent that would enable solvent desorption to be time-coincident with the textiles drying process. Apart from that, operation of small-sized chambers filled with adsorbent under high steam pressure becomes safer. One more advantage of said construction resides in a possibility of providing a unified adsorbent-containing chamber suitable for machine with different charging capacity.

It is expedient that an air cleaner for intercepting mechanical impurities be interposed between the adsorber and the steam heater, aimed at preventing coal dust and other mechanical impurities from getting into the steam heater and the device for separation and discharge of the steam and solvent condensate.

BRIEF DESCRIPTION OF THE DRAWINGS

Other objects and advantageous features of the present invention will become more apparent from a consideration of a detailed description of some specific embodiments thereof that follows, and from the accompanying drawings, wherein.

BRIEF DESCRIPTION OF THE PREFERRED EMBODIMENTS

Figure 1:
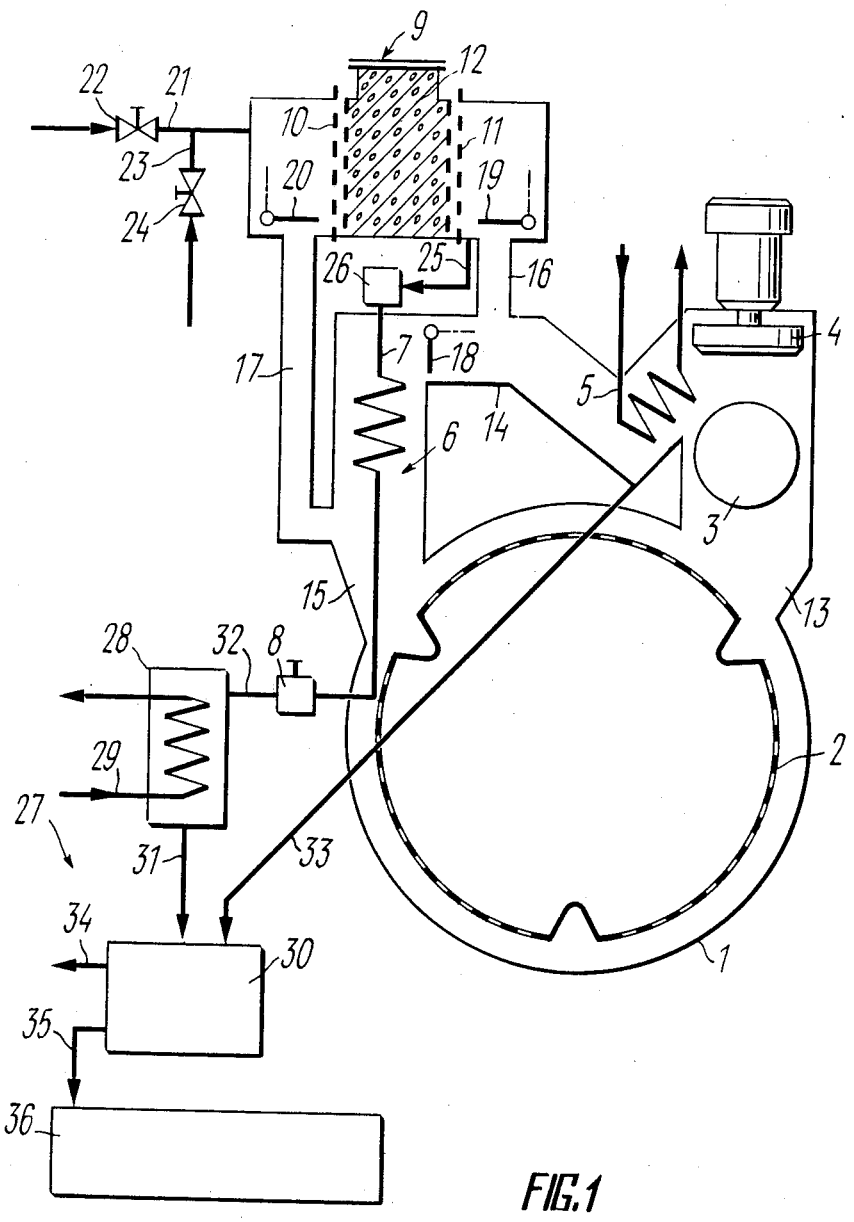
FIG. 1 is a schematic construction diagram of the machine, according to the invention.

The dry-cleaning machine as shown in FIG. 1, comprises a cage drum 2 rotatably mounted in a housing 1 and adapted to accommodate the textiles to be treated with solvents, subjected to centrifugal squeezing and drying. The machine comprises also an air cleaner 3 to get air rid of mechanical impurities, a blast fan 4, an air cooler 5, an air heater 6 provided with a steam heating element 7 and a device 8 for separation and discharge therefrom the steam and solvent condensate, and an adsorber 9, wherein an adsorbent 12 is enclosed within wire screens 10 and 11. Used as said adsorbent can be activated carbon granules, activated carbon fibres, and others. The amount of the adsorbent 12 used depends on its specific adsorptive capacity with respect to a given solvent, and on the charging capacity (mass) of the machine and is so selected as to provide catching of the solvent vapours at the final stage of drying the textiles under process involving air circulation through the cage drum 2 and the adsorber 9 within one operating cycle of the machine. The proportion of the adsorbent charged is calculated from the formula:

$$Q = K\frac{M \cdot C}{A},$$

where

Q is the mass of adsorbent contained in the adsorber, kg;

M is the charging capacity (mass) of the dry-cleaning machine, kg;

C is the specific solvent content of the textiles under process before air circulation through the cage drum and the adsorber, kg/kg;

A is the specific dynamic adsorptive capacity of the adsorbent, kg/kg;

K is the correction factor making allowance for reduction of the adsorbent capacity in the course of machine operation.

The aforesaid cage drum 2, air cleaner 3, blast fan 4, air cooler 5, air heater 6, and adsorber 9 are interconnected through air conduits 13, 14, 15, 16 and 17. A valve 18 is provided in the air conduit 14, while valves 19, 20 are installed in the adsorber 9. The valves 18, 19, 20 are adapted for changing (reversing) the direction of air flow at the various stages of drying the textiles under process. The valves 19 and 20 serve also for preventing steam against getting from the adsorber 9 to the cage drum 2 during solvent desorption.

The adsorber 9 is provided with an inlet connection 21 with a valve 22, adapted for steam admission to the adsorber for desorption of the solvent, as well as with an inlet connection 23 with a valve 24, adapted for air admission to the adsorber 9 either by a blower or a compressor (omitted in the Drawing) with a view to more completely displacing residual steam and condensate therefrom after solvent desorption. An outlet connection 25 is provided for discharging from the adsorber 9 a mixture of steam and desorbed solvent vapours, as well as condensate and air, said connection communicating with the inlet of the steam heating element 7 of the air heater 6. An air cleaner 26 adapted for intercepting coal dust and other mechanical impurities is interposed between the adsorber 9 and the steam heating element 7.

Provision is made in the machine for a means 27 aimed at cooling and separating the steam and solvent condensates coming from the steam heating element 7. The means 27 is in fact a heat exchanger 28 with a cooler 29, and a settler-type water trap 30, both being interconnected through a piping 31. The outlet of the steam heating element 7 is connected, via a piping 32 and the device 8 for condensate separation and discharge, to the heat exchanger 28 cooled with running water which is passed through the coiler 29 of the heat exchanger 28.

The water trap 30 is connected to the air cooler 5 through a piping 33. An outlet connection 34 and an inlet connection 35 of the water trap 30 are respectively for water discharge and for solvent admission to a tank 36 for its reuse in dry-cleaning of textiles.

The machine operates as follows.

Textile articles, e.g., clothing from woolen, cotton, or synthetic fabrics, are charged in the cage drum 2, treated with organic solvents according to an appropriate technique, centrifugally squeezed, and dried, while the solvent is recovered.

At the initial stage of drying the textiles the valve 18 is open, while the valves 19 and 20 are closed. Upon engagement of the blast fan 4 air starts circulating along a closed circuit, passing successively through the cage drum 2, the air cleaner 3, the air cooler 5, and the air heater 6. The solvent extracted from the textiles under process in the cage drum 2, is condensed from the circulating air in the air cooler 5 and runs through the piping 33 to the water trap 30 and is therefrom discharged through the connection 35 to the tank 36. Water withdrawn from the textiles under process along with the solvent, also flows along the piping 33 to the water trap 30 to be separated there from the solvent, and is discharged through the outlet connection 34.

Simultaneously with the start of the initial stage of drying the textiles under process the valve 22 is opened to admit steam at a pressure of 0.3 to 0.6 MPa to pass through the inlet connection 21 into the adsorber 9 for desorption from the adsorbent 12 of the solvent that has been caught within the preceding operating cycle of the machine. Having passed through the bed of the adsorbent 12, steam along with the desorbed solvent vapours is admitted, through the outlet connection 25 and the air cleaner 26, to the steam heating element 7 of the air heater 6, wherein heat exchange occurs between the solvent vapours and the circulating air. As a result, the solvent vapours are condensed, while the air is heated by virtue of the heat evolved during condensation, to a temperature required for drying the textiles under process.

A certain proportion of steam fed to the adsorber 9 is condensed therein (especially when the adsorber 9 is in a cooled state within the first operating cycle of the machine at the beginning of the workshift). It is by virtue of the heat liberated during the condensation process that desorption of the solvent from the adsorbent 12 occurs. The rest of steam passing through the adsorbent 12 serves for eliminating the desorbed solvent vapours from the adsorbent 12 and their conveyance to the steam heating element 7 of the air heater 6 for condensation.

Since the device 8 for condensate separation and discharge prevents steam and vapours from escaping and passes only their condensate that has been formed in the steam heating element 7 of the air heater 6, the system incorporating the adsorber 9 and the steam heating element 7 is under high steam pressure at a temperature corresponding to said saturated steam pressure. The rate of steam flow through the adsorbent 12 depends on the intensity of its condensation in the steam heating element 7 of the air heater 6, which in turn is determined by the drying conditions of the textiles under process. Studies performed by the inventors have demonstrated that reasonable solvent desorption conditions are maintained in this case, which provide for high efficiency of the process and cut down its duration. This in turn enables solvent desorption from the adsorbent 12 to be time-coincident with the technological process of drying the textiles involved, as well as makes it possible to considerably reduce a total consumption rate of steam spent for drying the textiles under process and solvent desorption. Any consumption of cooling water for condensing of steam and desorbed solvent vapours is rules out, since they are cooled with the air circulating during the drying of the textiles under process.

A mixture of condensates of steam and desorbed solvent vapours passes from the steam heating element 7 through the device 8 for condensate separation and discharge and along the piping 32 into the heat exchanger 28 to be cooled there with running water flowing along the cooler 29. Then the cooled mixture of condensates is fed along the piping 31 to the water trap 30, wherein the solvent is separated from the steam condensate due to a difference between their specific gravity values. Then the steam condensate is withdrawn through the connection 34, whereas the solvent is discharged through the connection 35 to the tank 36.

Upon completion of the solvent desorption process in the adsorber 9 the valve 22 of the connection 21 is closed, and steam stops to be passed through the adsorbent 12. Since air keeps circulating through the cage drum 2, the air cleaner 3, the air cooler 5 and the air heater 6, steam continues to condense in the steam heating element 7. This results in that a pressure difference is maintained for a certain period of time in the system consisting of the adsorber 9 and the steam heating element 7, whereby steam and its condensate are displaced from the adsorber 9 into the steam heating element 7.

Once the steam pressure in the adsorber 9 has dropped the valve 24 is opened to admit air to pass through the connection 23 into the adsorber 9 by being forced with a blast fan or compressor (omitted in the Drawing). This makes it possible to displace residual steam and its condensate from the adsorber 9 into the steam heating element 7 more efficiently. The heat liberated during condensation of the steam has been displaced into the steam heating element 7 is utilized for heating the air circulating in the course of drying the textiles under process. The air fed to the adsorber 9 through the connection 23, passes through the adsorbent 12, the air cleaner 26, the steam heating element 7, the device 8 for condensate separation and discharge, and the heat exchanger 28, is then directed to the water trap 30 along the piping 31 and discharged through the connection 34.

Upon displacing residual steam and condensate from the adsorber 9 the valve 24 is closed and air feed to the adsorber 9 is stopped. As soon as the air pressure in the adsorber 9 drops and the solvent content of the textiles under process is reduced to a preset level, the valve 18 is closed, while the valves 19 and 20 are opened, with the result that air starts circulating, by virtue of the blast fan 4, passing successively through the air cooler 5, the air conduit 16, the adsorbent 12, the air conduits 17 and 15, the cage drum 2, the air conduit 13, and the air cleaner 3.

The organic solvent is extracted from the textiles located in the cage drum 2, with the circulating air and is adsorbed from air by the adsorbent 12. The circulating air is heated in the adsorber 9 by virtue of the heat of adsorption evolved in the course of organic solvent adsorption, as well as due to the heat accumulated in the adsorbent 12 and in the components of the adsorber 9 that have become heated during solvent desorption. This contributes to more efficient solvent extraction from the textiles under process. As the solvent content of the textiles under process decreases, the amount of heat liberated during solvent adsorption is reduced and the adsorber 9 is cooled. Since the circulating air passes through the air cooler 5, its temperature decreases, which results in that the textiles under process are cooled before being discharged from the machine.

Figure 2:
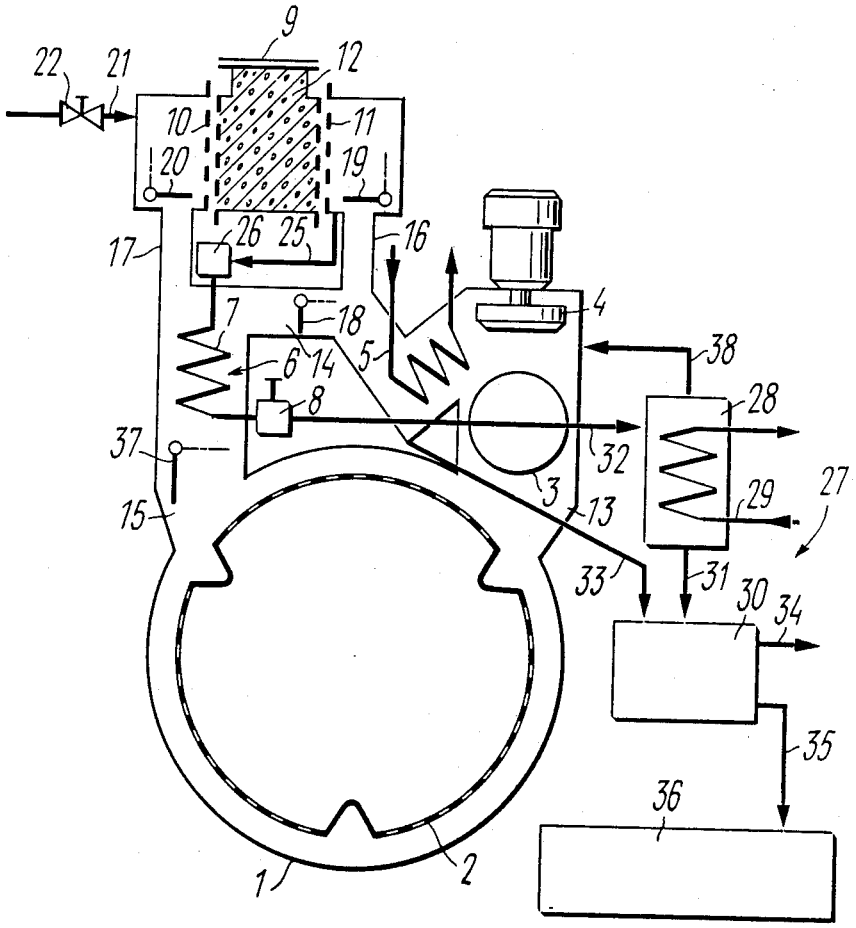
FIG. 2 is another version of a schematic construction diagram of the machine, according to the invention, provided with a closed system of displacement of residual steam and condensate from the adsorber after solvent desorption.

An embodiment of the dry-cleaning machine for textiles as illustrated in FIG. 2 is substantially similar to the machine shown in FIG. 1.

Unlike the machine presented in FIG. 1, the air conduit 17 communicates the adsorber 9 with the cage drum 2 through the air heater 6.

In addition, a valve 37 is provided in the air conduit 15 between the steam heating element 7 and the cage drum 2, while the top portion of the heat exchanger 28 is connected, through an air conduit 38, to the inlet of the blast fan 4 in order to feed air under pressure into the adsorber 9 for more intense displacement of residual steam and condensate therefrom after solvent desorption.

The textiles charged into the cage drum 2 are treated with organic solvents, squeezed and dried in the same way as in the machine of FIG. 1. Simultaneously with the first stage of drying the textiles under process, with the air circulating through the cage drum 2, the air cleaner 3, the air cooler 5 and the air heater 6, the solvent that has been adsorbed within the preceding operating cycle of the machine, is desorbed from the adsorbent 12. Steam is fed under pressure to the adsorber 9 through the connection 21 and the open valve 22, passes through the adsorbent 12 and is admitted, along with the desorbed solvent vapours, through the connection 25 and the air cleaner 26 to the steam heating element 7 of the air heater 6, wherein heat exchange occurs between the solvent vapours and the circulating air. As a result, the solvent vapours are condensed, while the air is heated to a temperature required for drying the textiles under process.

A mixture of condensates of steam and of the desorbed solvent vapours is fed from the steam heating element 7 through the device 8 for condensate separation and discharge and along the piping 32 to the heat exchanger 28 whence the cooled mixture of steam condensate and solvent vapour condensate is directed along the piping 31 to the water trap 30. Then the steam condensate is discharged from the water trap 30 through the connection 34, while the solvent is discharged through the connection 35 to the tank 36.

Once the solvent has been desorbed from the adsorbent in the adsorber 9, the valve 22 of the connection 21 is closed, steam passing through the adsorbent 12 ceases and the residual steam and condensate are displaced from the adsorber 9 into the steam heating element 7 of the air heater 6 by virtue of a difference between the pressures in said devices similarly to the machine of FIG. 1.

Once the steam pressure in the adsorber 9 has decreased, the valve 37 is closed and the valve 20 is opened, while the valve 18 remains open and the valve 19, closed. Air is force-fed by the blast fan 4 through the air cooler 5, and, upon passing along the air conduits 14 and 17, is admitted through the valve 20 to the adsorber 9. Having passed through the adsorbent 12 air is discharged from the adsorber 9 along with the steam and condensate displaced therefrom, through the connection 25 and the air cleaner 26 to the steam heating element 7 of the air heater 6, whence air is directed through the device 8 for condensate separation and discharge and along the piping 32 to the heat exchanger 28. Therefrom air is passed along the air conduit 38 to the inlet of the blast fan 4.

Upon displacement of the residual steam and condensate from the adsorber 9 the valve 18 is closed, while the valves 37 and 19 are opened, the valve 20 remaining open. Air starts circulating, by virtue of the blast fan 4, through the cage drum 2, the air cleaner 3, the air cooler 5, the adsorber 9, and the air heater 6. Since no heating of the air heater 6 by steam occurs, therefore the final stage of drying the textiles under process proceeds in the same way as in the machine of FIG. 1.

Figure 3:
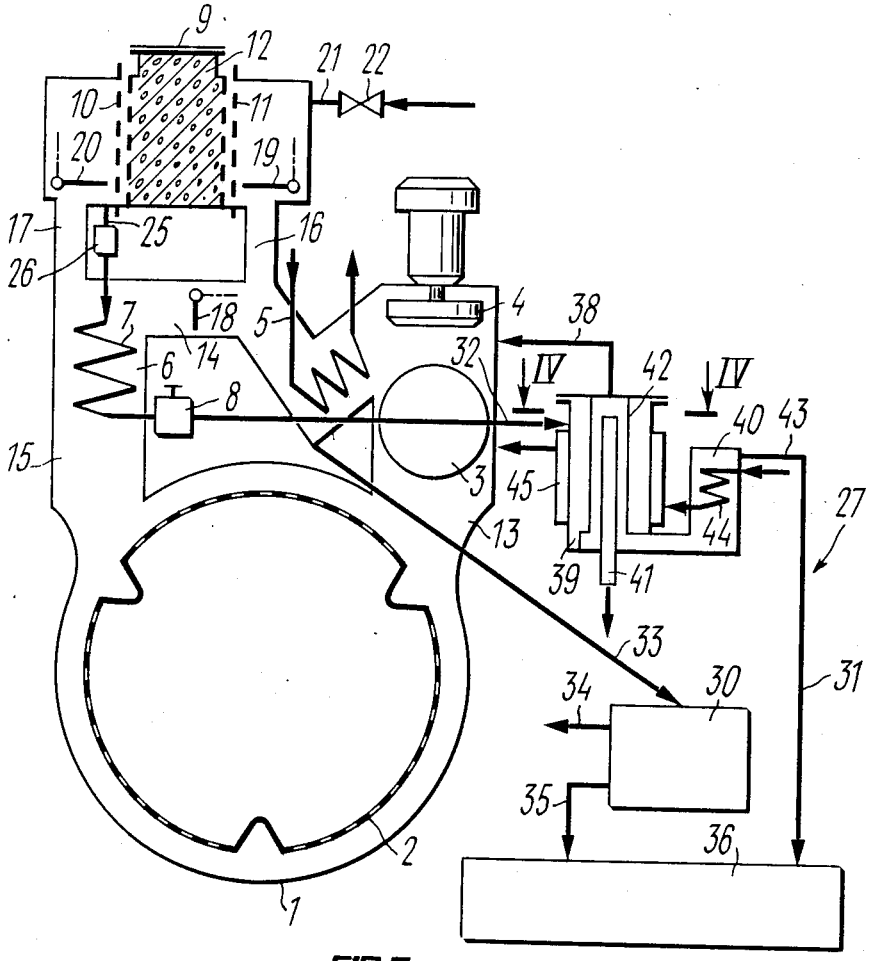
FIG. 3 is one more version of a schematic construction diagram of the machine, according to the invention, involving the use of a centrifugal effect for separating a mixture of condensates during solvent desorption from the adsorbent.
Figure 4:
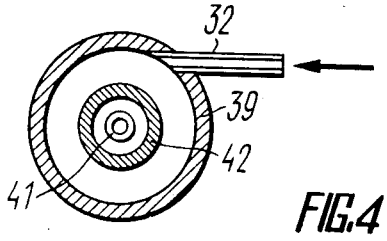
FIG. 4 is a section taken on the line IV—IV in FIG. 3.

An embodiment of the machine shown in FIG. 3 is substantially similar to the machine illustrated in FIG. 2. The means 27 for cooling and separating a mixture of steam condensate and solvent condensate is made up of two chambers 39 and 40 interconnected through their bottom portion. The chamber 39 is shaped as a cylinder (or as any other body of revolution). The piping 32 (FIG. 4) extends into the top portion of the chamber 39 tangentially to its internal surface. An outlet connection 41 is arranged along the centre line of the chamber 39 for the steam condensate to discharge.

The top portion of the connection 41 extends into a cylindrical sleeve 42 connected through the air conduit 38 to the inlet of the blast fan 4. An outlet connection 43 is provided in the top portion of the chamber 40 for the solvent to return to the tank 36 for reuse. Both of the chambers 39, 40 are cooled with running water passing through a coiler 44 and a cooling jacket 45.

The water trap 30 is connected through the piping 33 to the air cooler 5. The connection 34 serves for the separated water to discharge, while the connection 35, for the solvent to return to the tank 36.

The textiles charged into the cage drum 2 are treated with organic solvents, squeezed and dried in the same way as in the machines of FIGS. 1 and 2. Concurrently with the first stage of drying the textiles under process, with the air circulating through the cage drum 2, the air cleaner 3, the air cooler 5, and the air heater 6, the solvent that has been adsorbed within the previous operating cycle of the machine, is desorbed from the adsorbent 12. Steam is pressure-fed to the adsorber 9 through the connection 21 and the open valve 22, passes through the adsorbent 12 and is admitted, along with the desorbed solvent vapours, through the connection 25 and the air cleaner 26 to the steam heating element 7, wherein heat exchange occurs between the solvent vapours and the circulating air. As a result, the solvent vapours are condensed, while the air is heated to a temperature required for drying the textiles under process.

A mixture of condensates of steam and of the desorbed solvent vapours is force-fed from the steam heating element 7 through the device 8 and along the piping 32 (FIG. 4) to the chamber 32 tangentially to its internal surface and is set in rotary motion. It is under the thus-arising centrifugal force that the solvent having a greater density than water, moves away from the axis of the chamber 39 along a spiral pathway downwards, and is expelled into the chamber 40. The steam condensate moves in an inner spiral flow directed upwards, enters the cylindrical sleeve 42 and is discharged through the connection 41.

The chambers 39 and 40 are cooled with running water which passes successively through the cooler 44 in the chamber 40 and through the cooling jacket 45 of the chamber 39. It is in the chamber 39 that the steam and solvent condensates are cooled in the course of their separation and that steam and solvent vapours are condensed when penetrating into the chamber through the device 8 for condensate separation and discharge. The thus-separated solvent is additionally cooled in the chamber 40 and then discharged through the connection 43 to the tank 36 for reuse.

Use of a centrifugal effect in the means 27 makes it possible to attain higher efficiency of separation of a mixture of the steam and solvent condensates with a great proportion of steam condensate in said mixture, which is the case in the course of solvent desorption from the adsorbent of the adsorber 9.

Upon completion of the solvent desorption from the adsorbent of the adsorber 9, like in the embodiments of the machine as shown in FIGS. 1 and 2, the valve 22 of the connection 21 is closed and the residual steam and condensate are displaced from the adsorber 9 into the steam heating element 7 by virtue of a difference between the pressures effective in said devices, which continues to exist due to steam condensation that is proceeding in the steam heating element 7.

As soon as the steam pressure in the adsorber 9 decreases, the valve 18 is closed and the valve 19 is opened, while the valve 20 remains closed. Air is forced-fed by the blast fan 4 through the air cooler 5 and the air conduit 16 to the adsorber 9, passes through the adsorbent 12 and is discharged from the adsorber 9 along with the steam and condensate displaced by the air, through the connection 25 and the air cleaner 26 into the steam heating element 7, whence air is fed through the device 8 along the piping 32 to the chamber 39 of the means 27. Having been separated from water the solvent air is discharged from the top potion of the sleeve 42 along the air conduit 38 to the inlet of the blast fan 4.

As the amount of a mixture of condensates fed to the chamber 39 for separation is reduced, their pressure becomes insufficient to establish a considerable centrifugal effect due to their rotary motion. A difference in the levels at which are located the respective connections 41 and 43 for the steam condensate to discharge and for the solvent condensate to discharge is so designed as to make allowance for a difference in the density of said liquids so that in the case of a reduction of the centrifugal effect, the means 27 operates as a double-chamber settler-type continuous-action water trap. Besides, due to a lower amount of the mixture fed its more efficient separation is attained.

Once the residual steam and condensate have been displaced from the adsorber 9, the valve 18 is closed and the valve 20 is opened, while the valve 19 remains open. Air starts circulating, by virtue of the blast fan 4, through the cage drum 2, the air cleaner 3, the air cooler 5, the adsorber 9 and the air heater 6 similarly to the final stage of drying the textiles under process in the machine of FIG. 2.

Figure 5:
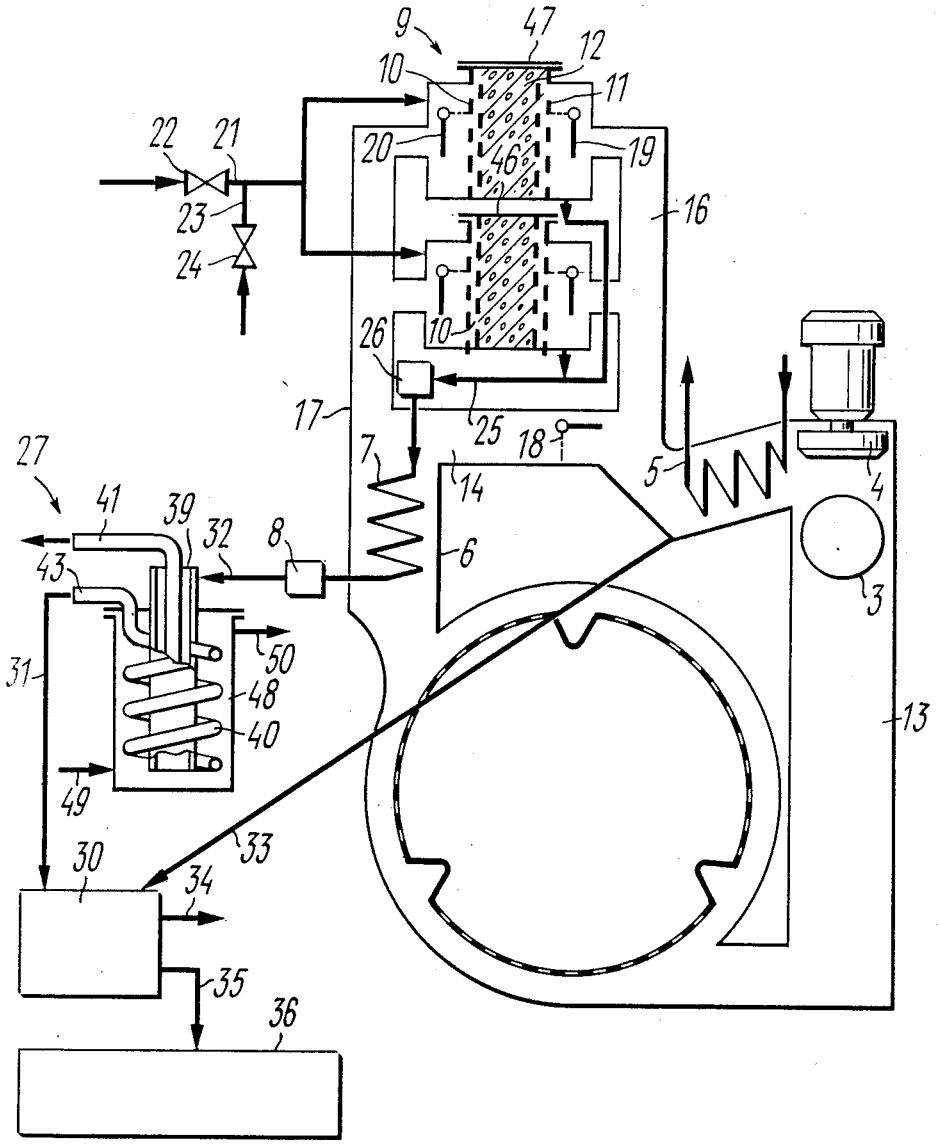
FIG. 5 is still one more version of a schematic construction diagram of the machine, according to the invention, featuring a double-chamber adsorber.

An embodiment of the machine shown in FIG. 5 is substantially similar to the embodiments illustrated in FIGS. 1, 2, 3; it comprises the housing 1 which accommodates the cage drum 2, the air cleaner 3 for getting air rid of mechanical impurities, the blast fan 4, the air cooler 5, the air heater 6 with the steam heating element 7 and the device 8 for condensate separation and discharge, all the components mentioned above being interconnected through the air conduits 13, 14, 15, 16 and 17, the air conduit 14 being provided with the valve 18. The air conduit 13 is connected to the cage drum 2 in its bottom portion, whereby organic solvents having a greater density than air will be exhausted from the cage drum 2 more efficiently.

The machine makes use of the adsorber 9 in the form of two parallel-connected chambers 46 and 47, wherein the adsorbent 12 is enclosed between the wire screens 10 and 11. Each of the chambers 46 and 47 is provided with the valves 19, 20. The connection 21 with the valve 22 is for steam admission to both of the chambers 46, 47 of the adsorber 9 at a time during solvent desorption, while the connection 23 with the valve 24 is for air feed by a blast fan or compressor (omitted in the Drawing) concurrently to both chambers 46, 47 of the adsorber 9 during displacement of the residual steam and condensate therefrom after solvent desorption. The connection 25 is for simultaneously discharging a mixture of steam and desorbed solvent vapours from the chambers 46, 47 of the adsorber 9, as well as condensate and air after solvent desorption. The connection 25 is connected, via the air cleaner 26 for intercepting mechanical impurities, to the input of the steam heating element 7 whose output is connected, through the piping 32 and the device 8 for condensate separation and discharge, to the means 27 for cooling and separating a mixture of steam and solvent condensates. The device comprises two chambers 39 and 40 interconnected through their bottom portion. The chamber 39 is cylinder-shaped. The piping 32 extends into the top portion of said chamber tangentially to its internal surface. The outlet connection 41 is arranged along the central line of the chamber 39 for steam condensate to discharge. The chamber 40 is shaped as a cooler and has the outlet connection 43 in its top portion for the solvent to discharge. Both of the chambers 39 and 40 are enclosed in a container 48 through which cooling water is passed via connections 49, 50.

The connection 43 communicates with the water trap 30 through the piping 31. Like the embodiments of machine illustrated in FIGS. 1, 2, 3 the water trap 30 is connected through the piping 33 to the air cooler 5 and has the connection 34 for the separated water to discharge, and the connection 35 for the solvent to return to the tank 36.

In the embodiment of the machine as shown in FIG. 5 the textiles under process charged into the cage drum 2 are treated with a solvent, squeezed and dried in the same way as in the machine of FIGS. 1, 2, 3. In the course of drying the textiles under process with air circulating through the cage drum 2, the air cleaner 3, the air cooler 5 and the air heater 6, the solvent that has been adsorbed within the previous operating cycle of the machine, is desorbed. Upon opening the valve 22 of the connection 21 steam is admitted to pass simultaneously to both of the chambers 46 and 47, flows through the beds of the adsorbent 12 and is discharged concurrently from both chambers 46, 47 through the connection 25, and the air cleaner 26 to the steam heating element 7 of the air heater 6, wherein heat exchange occurs between the solvent vapours and the circulating air. As a result, the solvent vapours are condensed, while the air is heated to a temperature required for drying the textiles under process.

A mixture of steam condensate and desorbed solvent vapours is force-fed, like in the machine embodiment shown in FIG. 3, from the steam heating element 7 through the device 8 for condensate separation and discharge and along the piping 32 to the chamber 39 tangentially to its internal surface, whereby the flow of the mixture is made to rotate. It is under the thus-arising centrifugal force that the solvent having a greater density than water moves away from the axis of the chamber 39 along a spiral pathway downwards, and is displaced into the chamber 40. The steam condensate moves in an inner spiral flow directed upwards and is discharged through the connection 41.

The chambers 39 and 40 are cooled with running water which is fed to the container 48 through the connection 49 and is withdrawn through the connection 50. Like the machine embodiment of FIG. 3, there occur in the chamber 39 the cooling of the steam and solvent condensates admitted thereto, as well as condensation of steam and solvent vapours when penetrating into the chamber through the device 8. Then the solvent is additionally cooled in the chamber 40 and then discharged through the connection 42 and along the piping 31 to the water trap 30 for final separation of the residual steam condensate. Next the solvent is fed from the water trap 30 to the tank 36 along the piping 35, while the separated water is discharged through the connection 34.

Upon completion of the solvent desorption the valve 24 is opened and air fed by a blast fan or compressor through the connection 23 concurrently to both chambers 46, 47, passes through the beds of the adsorbent 12 and is discharged simultaneously from both chambers 46, 47 along with the steam and condensate being displaced, through the connection 25 and the air cleaner 26 to the steam heating element 7 of the air heater 6. Therefrom air is directed through the device 8 for condensate separation and discharge and along the piping 32 to the chamber 39 of the means 27 for cooling and separating a mixture of condensate and is discharged through the connection 41.

Like the machine embodiment of FIG. 3 the means 27 can operate, whenever the amount of a mixture of liquids to be separated is reduced, as a double-chamber settler-type continuous-action water trap.

Once the residual steam and condensate have been displaced from both chambers 46, 47, the valve 18 is closed and the valves 19, 20 are opened. Air is withdrawn by the fan 4 from the bottom portion of the cage drum 2 through the air conduit 13, passes through the air cleaner 3, the air cooler 5 and is fed along the air conduit 16 concurrently to both of the adsorption chambers 46 and 47, then is discharged therefrom along the air conduit 17 and is returned, through the air heater 6, to the cage drum 2.

We claim:

1. A dry-cleaning machine for textiles, comprising:

a housing;

a cage drum enclosed in said housing;

a blast fan;

an air cleaner to get rid of mechanical impurities;

an air cooler;

an air heater having a means for heating air by condensation of steam, the means for heating air having an inlet and outlet;

an adsorber;

an adsorbent contained in said adsorber for adsorbing a solvent;

an inlet connection for steam admission to said adsorber during desorption of said solvent from said adsorbent;

an outlet connection for discharging a mixture of steam and vapours of said desorbed solvent from said adsorber said outlet connection for discharging a mixture of steam and vapours of said desorbed solvent communicates with the inlet of said means for heating air;

air conduits, communicating together with said cage drum, blast fan, air cleaner, air cooler, air heater and adsorber, for the air to flow in a path through the air conduits;

a system of valves provided in said air conduits for changing the path of air flow during drying the textiles under process and for preventing steam from penetrating into said cage drum in the course of desorption of said solvent;

a means, in communication with the outlet of the means for heating air, for cooling and separating a mixture of condensates of steam and desorbed solvent vapours passing from the means for heating air;

a means for separating the condensate from the steam and desorbent solvent vapours and discharging it from said means for heating air, said means being interposed between said air heater and said means for cooling and separating the mixture of condensates; and wherein the amount of said adsorbent contained in said adsorber and its adsorption capacity are so selected as to provide for adsorption of the vapours of said solvent at the final stage of drying the textiles under process involving air circulation through said cage drum and said adsorber within one operating cycle of the machine.

2. A machine as claimed in claim 1, wherein the means for cooling and separating a mixture of condensates of steam and desorbed solvent vapours incorporates two cooled chambers interconnected through their bottom portion, one of said chambers being shaped as a body of revolution and provided with a tangential outlet connection for steam condensate to be discharged, while the other chamber has an outlet connection for said solvent to be discharged.

3. A machine as claimed in claim 1, wherein said means for cooling and separating a mixture of condensates of steam and solvent vapours is connected, through an air conduit, to the blast fan so as to provide air circulation and displacement of residual steam and condensate after desorption of said solvent from said adsorber.

4. A machine as claimed in claim 1, wherein said adsorber has an inlet connection for compressed air to be admitted thereto in order to displace residual steam and condensate after desorption of said solvent from said adsorber.

5. A machine as claimed in claim 1, wherein said adsorber is made up of at least two parallel-interconnected chambers containing said adsorbent.

6. A machine as claimed in claim 1, wherein an air cleaner (26), for intercepting mechanical impurities, is interposed between said adsorber and said inlet of the means for heating air.

* * * * *